US009941074B2

(12) United States Patent
Tu

(10) Patent No.: US 9,941,074 B2
(45) Date of Patent: Apr. 10, 2018

(54) KEY STRUCTURE AND KEYBOARD USING THE SAME

(71) Applicant: ASUSTeK COMPUTER INC., Taipei (TW)

(72) Inventor: Ya-Chun Tu, Taipei (TW)

(73) Assignee: ASUSTEK COMPUTER INC., Taipei (TW)

( * ) Notice: Subject to any disclaimer, the term of this patent is extended or adjusted under 35 U.S.C. 154(b) by 0 days.

(21) Appl. No.: 15/297,237

(22) Filed: Oct. 19, 2016

(65) Prior Publication Data

US 2017/0125190 A1 May 4, 2017

Related U.S. Application Data

(60) Provisional application No. 62/251,028, filed on Nov. 4, 2015.

(30) Foreign Application Priority Data

Aug. 2, 2016 (TW) ..... 105124525 A

(51) Int. Cl.
*H01H 13/7065* (2006.01)
*H01H 13/14* (2006.01)
(Continued)

(52) U.S. Cl.
CPC ..... *H01H 13/7065* (2013.01); *H01H 13/14* (2013.01); *H01H 13/06* (2013.01);
(Continued)

(58) Field of Classification Search
CPC .... H01H 13/06; H01H 2223/002; H01H 9/04; H01H 13/86; H01H 2009/048
(Continued)

(56) References Cited

U.S. PATENT DOCUMENTS 7,557,313 B2 7/2009 Chao
8,263,886 B2 9/2012 Lin et al.
(Continued)

FOREIGN PATENT DOCUMENTS

CN 201226317 Y 4/2009
CN 204029682 U 12/2014
(Continued)

OTHER PUBLICATIONS

Office Action issued in corresponding Taiwan patent application dated Jun. 21, 2017.

*Primary Examiner* — Ahmed Saeed
(74) *Attorney, Agent, or Firm* — McClure, Qualey & Rodack, LLP

(57) ABSTRACT

A key structure comprises a substrate, a membrane circuit disposed on the substrate, a waterproof structure disposed on the membrane circuit, a keycap, a conduction switch and a scissors structure. The waterproof structure includes a waterproof plate and a waterproof wall with a through hole. The waterproof wall surrounds the through hole and extends opposite to the membrane circuit. An end of the conduction switch passes through the through hole to be disposed on the membrane circuit, and the other end of the conduction switch protrudes from the waterproof wall to be connected to the keycap. The scissors structure includes a first end portion and a second end portion. The first end portion is pivotally connected to the keycap, and the second end portion is pivotally connected to the waterproof wall for the keycap to move up and down relatively to the membrane circuit.

7 Claims, 6 Drawing Sheets

(51) Int. Cl.
*H01H 13/06* (2006.01)
*H01H 19/04* (2006.01)
*H01H 13/86* (2006.01)

(52) U.S. Cl.
CPC ..... *H01H 13/86* (2013.01); *H01H 19/04* (2013.01); *H01H 2223/002* (2013.01)

(58) Field of Classification Search
USPC ..... 200/5 A, 341–345, 302.1, 302.2
See application file for complete search history.

(56) References Cited

U.S. PATENT DOCUMENTS

| | | | | |
|---|---|---|---|---|
| 9,000,312 | B2 | 4/2015 | Shen et al. | |
| 2005/0013645 | A1* | 1/2005 | Tsai | G06F 1/1616 400/472 |

FOREIGN PATENT DOCUMENTS

| | | |
|---|---|---|
| TW | M316438 | 8/2007 |
| TW | I380333 | 12/2012 |
| TW | I452589 | 9/2014 |

* cited by examiner

KEY STRUCTURE AND KEYBOARD USING THE SAME

CROSS-REFERENCE TO RELATED APPLICATION

This application claims the priority benefit of U.S. provisional application Ser. No. 62/251,028, filed on Nov. 4, 2015 and TW application No. 105124525, filed on Aug. 2, 2016. The entirety of the above-mentioned patent applications are hereby incorporated by references herein and made a part of specification.

BACKGROUND OF THE INVENTION

Field of the Invention

The disclosure relates to a keyboard and, more specifically, to a waterproof keyboard.

Description of the Related Art

In a conventional keyboard configured at an electronic device (such as a tablet computer), an elastic conduction switch is disposed on a membrane circuit and a keycap is disposed on the conduction switch. The conduction switch is triggered by pressing the keycap and enables a corresponding keying circuit of the membrane circuit, and then a keying signal corresponding to the keystroke is sent out. Usually, the membrane circuit is below the keycap. When liquid is spilt onto the keyboard accidentally, the liquid would flow to the membrane circuit through the gap(s) between the keycaps and the circuit is easily damaged.

Additionally, a scissor-type positioning structure is configured to enable the keycap to move up and down within a certain distance. A supporting plate is mounted below the membrane circuit for installing a frame of the scissors structure thereto. However, in such a way, many holes are required to be formed at the membrane circuit for the frame to pass through these holes to install the scissors structure. The layout of the membrane circuit becomes complex.

BRIEF SUMMARY OF THE INVENTION

According to one aspect of the disclosure, a key structure is provided. The key structure comprises: a substrate, a membrane circuit disposed on the substrate, a waterproof structure disposed on the membrane circuit and including a waterproof plate and a waterproof wall, a keycap, a conduction switch, and a scissors structure including a first end portion and a second end portion. The waterproof plate includes a through hole. The waterproof wall surrounds the through hole and extends toward a direction opposite to the membrane circuit. An end of the conduction switch passes through the through hole to be disposed on the membrane circuit, and the other end of the conduction switch protrudes out of the waterproof wall to be connected to the keycap. The first end portion is pivotally connected to the keycap, and the second end portion is pivotally connected to the waterproof wall for the keycap to move up and down relatively to the membrane circuit.

According to another aspect of the disclosure, a key structure is provided. The key structure comprises a case, a substrate disposed in the case, a membrane circuit disposed on the substrate, a waterproof structure disposed on the membrane circuit, a plurality of keycaps, a plurality of conduction switches and a plurality of scissors structures. The waterproof structure includes a waterproof plate and a plurality of waterproof walls. The waterproof plate includes a plurality of through holes. Each of the waterproof walls surrounds the through hole and extends toward a direction opposite to the membrane circuit. An end of the conduction switch passes through the through hole to be disposed on the membrane circuit, and the other end of the conduction switch protrudes out of the waterproof wall to be connected to the keycap. Each of the scissors structures includes a first end portion and a second end portion. The first end portion is pivotally connected to the keycap, and the second end portion is pivotally connected to the waterproof wall for the keycap to move up and down relatively to the membrane circuit.

In sum, in embodiments, the waterproof structure is configured on the membrane circuit to block and retain the liquid spilt onto the keys or the keyboard within the waterproof structure to avoid the damage to the membrane circuit from the liquid. Furthermore, the scissors structure is pivotally connected to the waterproof wall of the waterproof structure. Therefore, too many holes are not needed to be configured at the membrane circuit, which facilitates the layout of the membrane circuit.

BRIEF DESCRIPTION OF THE DRAWINGS

These and other features, aspects and advantages of the disclosure will become better understood with regard to the following embodiments and accompanying drawings.

DETAILED DESCRIPTION OF THE EMBODIMENTS

Figure 1:
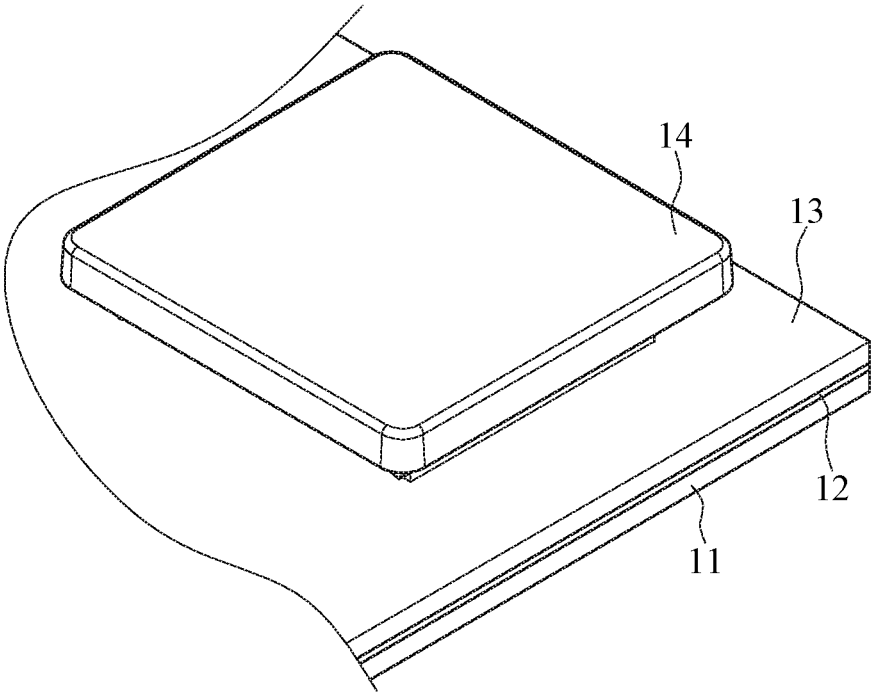
FIG. 1 is a schematic diagram showing a key structure in a first embodiment.
Figure 2:
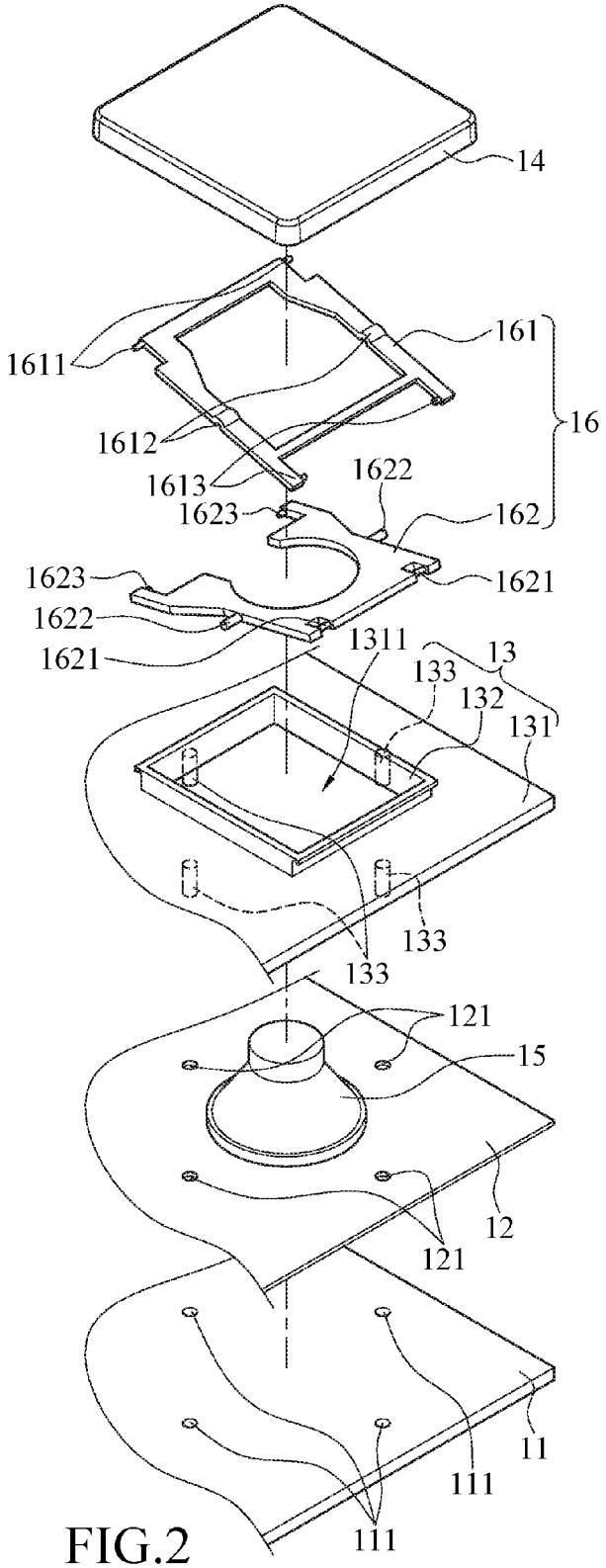
FIG. 2 is an exploded diagram showing the key structure in the first embodiment.
Figure 3:
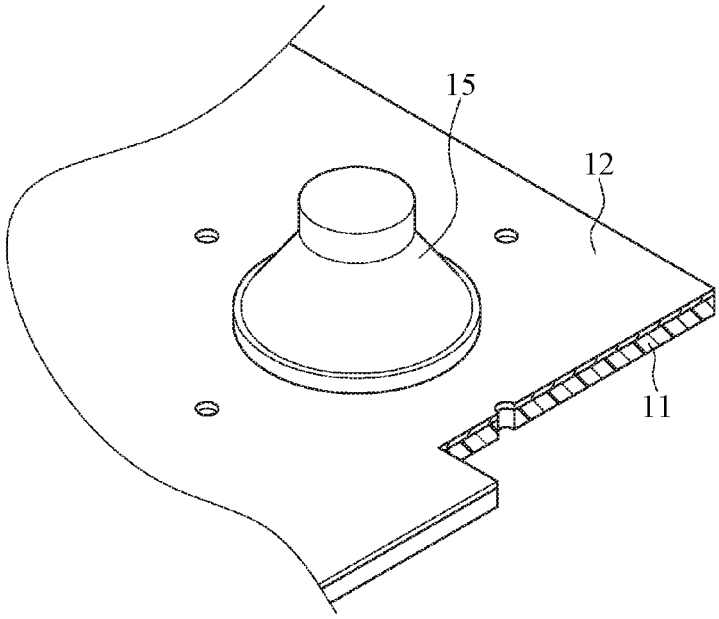
FIG. 3 is a first schematic diagram showing the key structure in assembling in the first embodiment.
Figure 4:
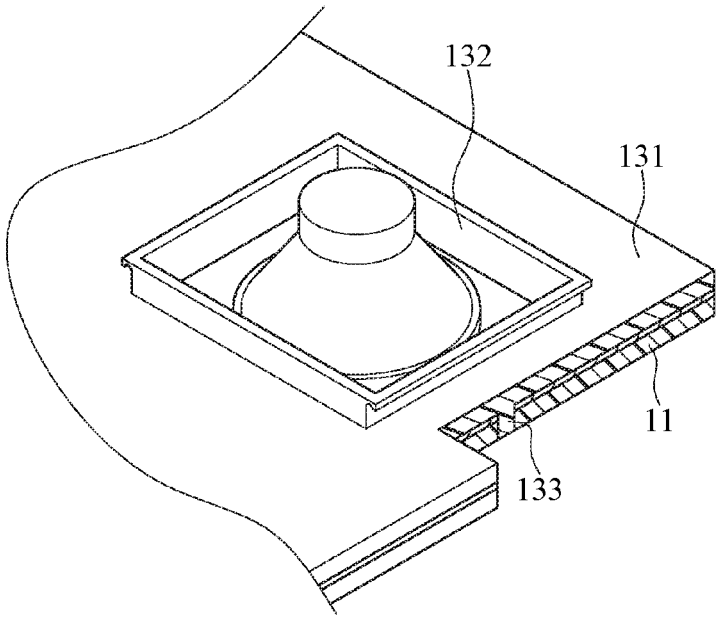
FIG. 4 is a second schematic diagram showing the key structure in assembling in the first embodiment.
Figure 5:
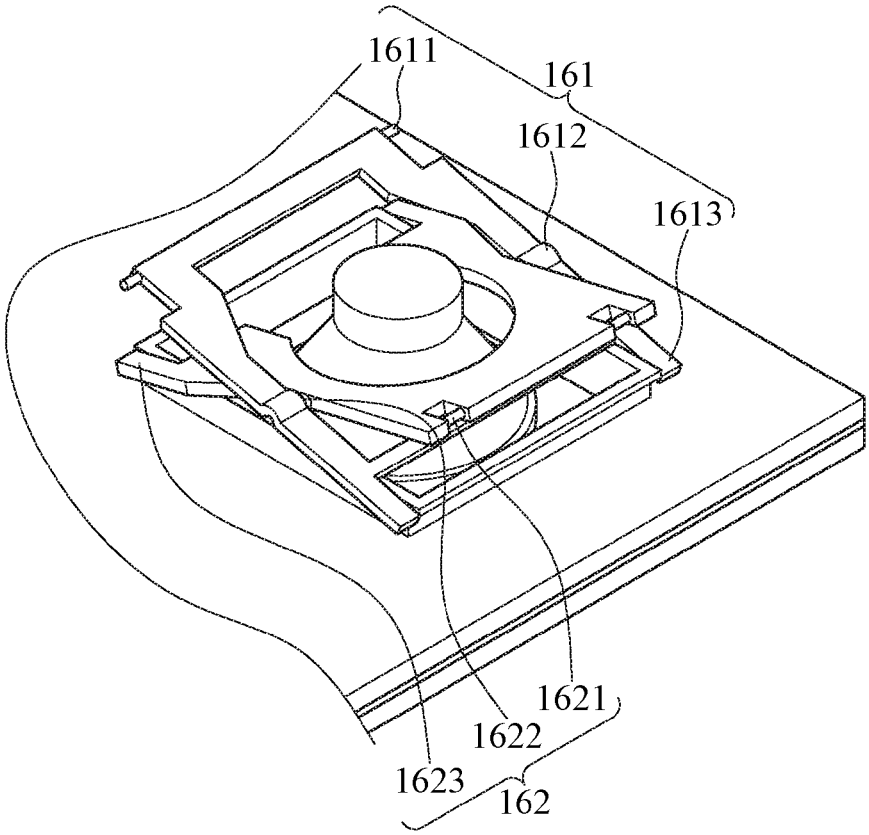
FIG. 5 is a third schematic diagram showing the key structure in assembling in the first embodiment.

Please refer to FIG. 1 to FIG. 5, FIG. 1 is a schematic diagram showing a key structure in a first embodiment, FIG. 2 is an exploded diagram showing the key structure in the embodiment; and FIG. 3 to FIG. 5 are schematic diagrams showing the key structure in the assembly of the first embodiment. In the embodiment of a key structure, only one key is exemplified for illustration. However, the number of the keys configured at a keyboard is not limited herein.

As shown in FIG. 1 and FIG. 2, in the embodiment, a key structure includes a substrate 11, a membrane circuit 12, a waterproof structure 13, a keycap 14, a conduction switch 15 and a scissors structure 16. Please refer to FIG. 3 to FIG. 5, in the embodiment, the key structure is assembled in a sequence described hereinafter. However, in other embodiments, the sequence for assembling the keyboard can be changed, which is not limited herein.

As shown in FIG. 3, first, the conduction switch 15 is attached to the membrane circuit 12. The conduction switch 15 is pressed to conduct a control circuit of the membrane circuit 12. Then, the membrane circuit 12 with the conduction switch 15 thereon is configured to the substrate 11.

Please refer to FIG. 2 and FIG. 4, the waterproof structure 13 is configured on the membrane circuit 12. The waterproof structure 13 includes a waterproof plate 131, a waterproof wall 132 and a fixing pillar 133. The waterproof plate 131 includes a through hole 1311. When the waterproof structure 13 is configured on the membrane circuit 12, the through hole 1311 is disposed corresponding to the conduction switch 15. The conduction switch 15 passes through the through hole 1311 and configures on the membrane circuit 12. The waterproof wall 132 surrounds the through hole 1311 and extends toward a direction opposite to the membrane circuit 12. In the embodiment, the waterproof wall 132 has a certain height. When a large amount of the liquid is spilt onto the waterproof structure 13, the waterproof wall 132 blocks the liquid from flowing to the membrane circuit 12. In the embodiment, the waterproof plate 131 and the waterproof wall 132 are formed in one piece. In other embodiments, the waterproof wall 132 is fixed to the waterproof plate 131 via welding or gluing, which is not limited herein.

As shown in FIG. 2 and FIG. 4, in the embodiment, the through hole 1311 and the waterproof wall 132 are rectangular, and the waterproof wall 132 is configured to surround the edges of the through hole 1311. In other embodiments, the through hole 1311 and the waterproof wall 132 are round or in other shapes, which is not limited herein. In an embodiment, the waterproof wall 132 is, or is not configured exactly along the edge of the through hole 1311, and a shape of an area surrounded by the waterproof wall 132 is, or is not the same as the shape of the through hole 1311. For example, the through hole 1311 is round, and the size of the through hole 1311 is a little larger than that of an outer periphery (at a side connecting with the membrane circuit 12) of the conduction switch 15. In such a way, a gap between the waterproof plate 131 and the conduction switch 15 is reduced, and the liquid would not flow to the membrane circuit 12 easily because of the surface tension. In an embodiment, the waterproof wall 132 is configured to surround the through hole 1311 along the circular shape of the through hole. In another embodiment, the waterproof wall 132 is configured to surround the through hole 1311 along a rectangular path. Since the waterproof wall 132 surrounds the through hole 1311, whatever the shape of the waterproof wall 132 is, the liquid on the waterproof plate 131 would be blocked from flowing into the through hole 1311 directly.

Please refer to FIG. 2 to FIG. 4, in the embodiment, a plurality of first perforations 111 are formed on the substrate 11, and a plurality of second perforations 121 are formed on the membrane circuit 12. The positions of the first perforations 111 correspond to those of the second perforations 121, respectively. When the membrane circuit 12 is configured onto the substrate 11, the first perforations 111 are aligned with the second perforations 121, respectively. The fixing pillars 133 of the waterproof structure 13 are fixed to a surface of the membrane circuit 12 adjacent to the waterproof plate 131 and extend toward a direction opposite to that of the waterproof wall 132. In another word, the fixing pillars 133 are disposed on the surface of the waterproof plate 131 at a side opposite to the waterproof wall 132. That is, the fixing pillar 133 and the waterproof wall 132 each extend toward opposite directions, respectively. In an embodiment, the number and position of the fixing pillars 133 correspond to those of the first perforation 111 and the second perforation 121, respectively.

As shown in FIG. 1 and FIG. 4, when the waterproof structure 13 is configured on the membrane circuit 12, the fixing pillar 133 passes through the corresponding first perforation 111 and second perforation 121. The substrate 11, the membrane circuit 12 and the waterproof structure 13 are positioned via the fixing pillar 133 passing through the first perforation 111 and the second perforation 121. Then, the fixing pillar 133 is further fixed to the substrate 11 via welding or gluing to avoid the disengagement of the waterproof plate 131. In the configuration, no additional structures/components are needed to further fix or connect the layers (such as the membrane circuit 12) to the substrate 11. In the embodiment, the number of the first perforation 111, the second perforation 121 and the fixing pillar 133 is four, respectively. However, the number of the first perforation 111, the second perforation 121 and the fixing pillar 133 is not limited herein.

Please refer to FIG. 2 and FIG. 5, after the waterproof structure 13 is assembled, an end of the scissors structure 16 is connected pivotally to the waterproof wall 132. In the embodiment, the scissors structure 16 includes a first connecting foot 161 and a second connecting foot 162. The first connecting foot 161 includes a first pivot portion 1611, a second pivot portion 1612 and a third pivot portion 1613. The second connecting foot 162 includes a first pivot portion 1621, a second pivot portion 1622 and a third pivot portion 1623. The second pivot portion 1612 of the first connecting foot 161 and the second pivot portion 1622 of the second connecting foot 162 are pivotally connected to form the scissors structure 16 as a pivot. The first pivot portions 1611, 1621 above the second pivot portions 1612, 1622 are defined as a first end portion of the scissors structure 16, and the third pivot portions 1613, 1623 below the second pivot portions 1612, 1622 are defined as a second end portion of the scissors structure 16.

The second end portion of the scissors structure 16 is pivotally connected to the waterproof wall 132. In the embodiment, the third pivot portion 1623 of the second connecting foot 162 is pivotally connected to a side edge of the waterproof wall 132, and the third pivot portion 1613 of the first connecting foot 161 is pivotally connected to the other side edge of the waterproof wall 132. Finally, the keycap 14 is assembled. The first end portion of the scissors structure 16 is pivotally connected to the keycap 14, and the other end of conduction switch 15 is connected to the keycap 14. That is, the first pivot portion 1621 of the second connecting foot 162 is pivotally connected to a side of the keycap 14, and the first pivot portion 1611 of the first connecting foot 161 is connected pivotally to the other side of the keycap 14. The end of the conduction switch 15 protruding out of the waterproof wall 132 is connected to the keycap 14.

In the embodiment, the waterproof structure 13 is configured on the membrane circuit 12 to block and retain the liquid that spilt onto the keys or keyboard in accident within the waterproof structure 13 to prevent the damage of the membrane circuit 12. Furthermore, the scissors structure 16 is pivotally connected to the waterproof wall 132 of the waterproof structure 13. Therefore, less holes are required on the membrane circuit. The layout of the membrane circuit is more flexible. Additionally, since the waterproof plate 131 of the waterproof structure 13 helps to enhance the strength of the whole structure, the thickness of the substrate 11 becomes thinner.

In the embodiment, to provide a better waterproof effect, the section area of the through hole 1311 is smaller than an area of the upper surface of the keycap 14. As shown in FIG. 2, the upper surface of the keycap 14 is larger than the rectangular section area of the through hole 1311. Therefore, the through hole 1311 is completely covered by the keycap 14. As a result, when the liquid is spilt onto the key structure in accident, the keycap 14 may block most of the liquid from flowing into the through hole 1311 directly.

Figure 6:
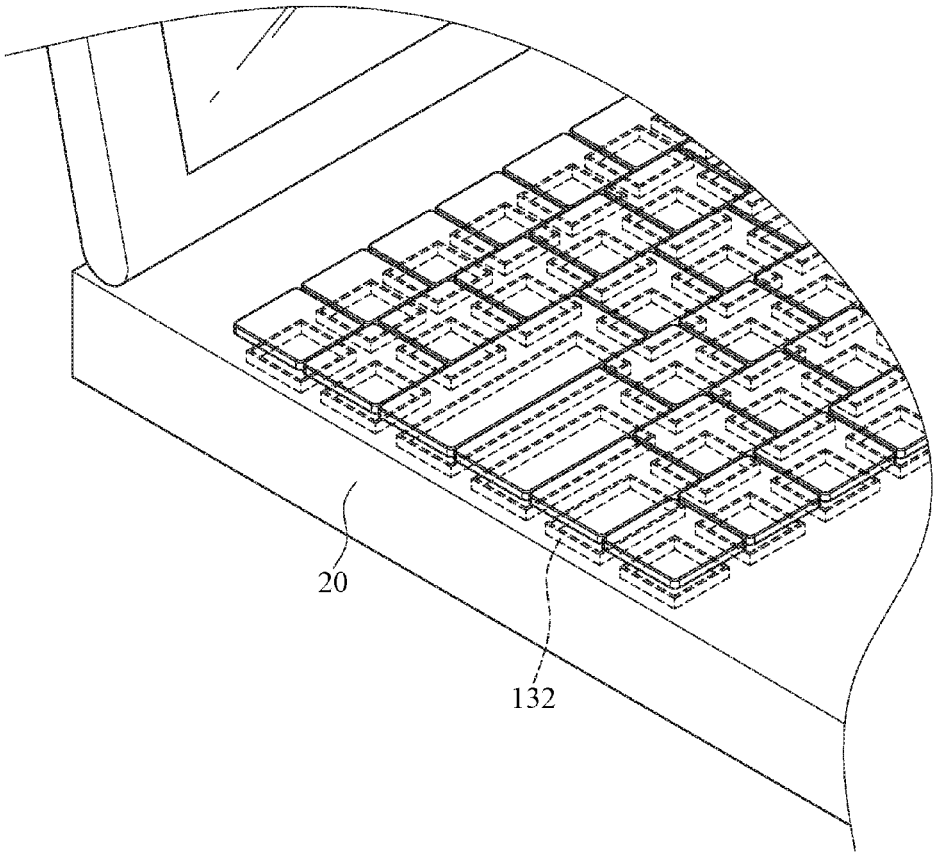
FIG. 6 is a schematic diagram showing partial of the key structure in the second embodiment.
Figure 7:
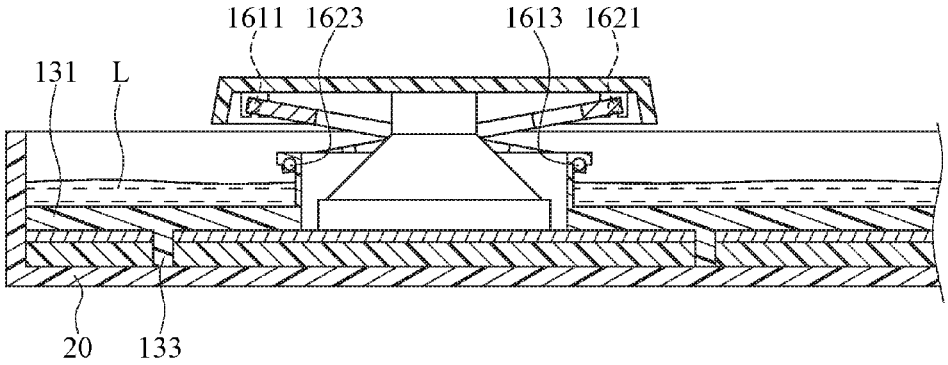
FIG. 7 is a section view of one key structure of a keyboard in the second embodiment.

Please refer to FIG. 6 and FIG. 7, FIG. 6 is a schematic diagram showing partial of the key structure in the second embodiment, and FIG. 7 is a section view of one key structure of a keyboard in the second embodiment. In the embodiment, a keyboard configured in a notebook is exemplified for illustration, which is not limited herein. In the embodiment, the keyboard includes a case 20, a substrate 11, a membrane circuit 12, a waterproof structure 13, a plurality of keycaps 14, a plurality of conduction switches 15 and a plurality of scissors structures 16. In the embodiment, the key structure in the first embodiment is configured in the case 20 of the keyboard. Therefore, in the embodiment, the same or similar component to that in the first embodiment is denoted by the same/similar reference symbol. In the embodiment, a plurality of the key structures in the first embodiment are configured in the keyboard. In an embodiment, to have a better waterproof effect, all keys of the keyboard are configured with the waterproof structure 13. In an embodiment, only a part of the keys are configured with the waterproof structure 13, which is not limited herein.

In the embodiment, the waterproof structure 13 includes a waterproof plate 131, a plurality of waterproof walls 132 and a plurality of fixing pillars 133. The waterproof plate 131 includes a plurality of through holes 1311. Each waterproof wall 132 corresponds to one keycap 14. That is, the through holes 1311 and the waterproof walls 132 are configured on one waterproof plate 131 to correspond to a plurality of keys, respectively. In the embodiment, the number of the fixing pillars 133 is changed according to the practical requirement. In an embodiment, the fixing pillar 133 does not need to be configured for each key. In an embodiment, at least one fixing pillar 133 is configured onto the whole waterproof plate 131 to make the substrate 11, the membrane circuit 12 and the waterproof structure 13 positioned and fixed to each other.

Similarly, as described in the first embodiment, each key structure includes one conduction switch 15. An end of the conduction switch 15 passes through the through hole 1311 and is configured on the membrane circuit 12. The other end of the conduction switch 15 protrudes out of the waterproof wall 132 and is connected to one keycap 14. In the embodiment, each key structure further includes one scissors structure 16. A first end portion of the scissors structure 16 is pivotally connected to the keycap 14, and the second end portion of the scissors structure 16 is pivotally connected to the waterproof wall 132, and thus the keycap 14 moves up and down relatively to the membrane circuit 12. In such a way, each key of the keyboard is waterproof. When the liquid is spilt onto the keyboard, the liquid would not flow to the membrane circuit 12 directly and cause damages.

Please refer to FIG. 7, in this section view, for clarity, only one key structure is exemplified. A distance between the two opposite side of the first end portion of the scissors structure 16 of the key structure is larger than the distance between the two opposite side of the second end portion. Please refer to FIG. 2 and FIG. 7, the distance between the two opposite side of the first end portion refers to the distance between the first pivot portion 1611 of the first connecting foot 161 and the first pivot portion 1621 of the second connecting foot 162. The distance between opposite sides of the second end portion refers to the distance between the third pivot portion 1613 of the first connecting foot 161 and the third pivot portion 1623 of the second connecting foot 162.

In the embodiment, please refer to FIG. 2 and FIG. 7, a side edge of the waterproof plate 131 is connected to a side wall of the case 20. When the liquid L is split onto the keyboard, the liquid L is blocked and retained on the waterproof plate 131 by the waterproof wall 132 and the side wall of the case 20, and thus the liquid L would not spread into the case 20. The liquid L spilt onto the keyboard can be easily cleaned or dried, instead of accumulate the liquid L on the keyboard and wait for dry naturally. The effort of replacing the whole keyboard is also saved since the damage by liquid is not occurred easily. In the embodiment, one side edge of the waterproof plate 131 is exemplified to be connected to the side wall of the case 20 for illustration. In another embodiment, four side edges of waterproof plate 131 are connected to the four side walls, respectively, to retain the liquid L on the waterproof plate 131.

Figure 8:
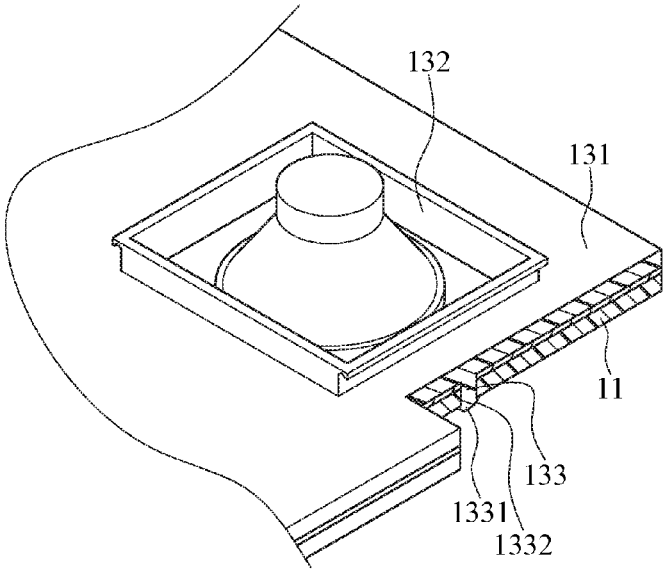
FIG. 8 is a schematic diagram showing partial of the key structure in assembling in the third embodiment.

Please refer to FIG. 8. FIG. 8 is a schematic diagram showing partial of the key structure in assembling in the third embodiment. In the embodiment, the same component or similar to that in the first embodiment is denoted by the same or similar reference symbol. In the embodiment, the key structure includes a substrate 11, a membrane circuit 12, a waterproof structure 13, a keycap 14, a conduction switch 15 and a scissors structure 16. In the embodiment, the fixing pillar 133 of the waterproof structure 13 is different from that in the first embodiment. As shown in FIG. 8, an end of the fixing pillar 133 includes a protrusion 1331 extending toward a radial direction of the fixing pillar 133. To facilitate the assembly, the protrusion 1331 includes a slope 1332. Thus, the fixing pillar 133 can be easily aligned with and passes through the first perforation 111 and the second perforation 121.

In the embodiment, after the fixing pillar 133 passes through the first perforation 111 and the second perforation 121, the protrusion 1331 abuts against a surface of the substrate 11 that away from the membrane circuit 12. In such a way, without the welding or the gluing way, the substrate 11, the membrane circuit 12 and the waterproof plate 131 are fixedly connected with each other, which is simple.

Although the disclosure has been disclosed with reference to certain embodiments thereof, the disclosure is not for limiting the scope. Persons having ordinary skill in the art may make various modifications and changes without departing from the scope of the disclosure. Therefore, the scope of the appended claims should not be limited to the description of the embodiments described above.

What is claimed is:

1. A key structure comprising:

a substrate, including a plurality of first perforations;

a membrane circuit disposed on the substrate and including a plurality of second perforations;

a waterproof structure disposed on the membrane circuit and including a waterproof plate, a waterproof wall, and a plurality of fixing pillars, wherein the waterproof plate includes a through hole, the waterproof wall surrounds the through hole and extends toward a direction opposite to the membrane circuit, and each of the fixing pillars is fixed to a surface of the waterproof plate adjacent to the membrane circuit and extends toward a direction opposite to the waterproof wall to pass through one of the plurality of first perforations and one of the plurality of second perforations;

a keycap;

a conduction switch, wherein an end of the conduction switch passes through the through hole to be disposed on the membrane circuit, and the other end of the conduction switch protrudes out of the waterproof wall to be connected to the keycap; and a scissors structure including a first end portion and a second end portion, wherein the first end portion is pivotally connected to the keycap, and the second end portion is pivotally connected to the waterproof wall for the keycap to move up and down relatively to the membrane circuit.

2. The key structure according to claim 1, wherein an area of the through hole is smaller than an area of an upper surface of the keycap.

3. The key structure according to claim 1, wherein an end of each fixing pillar includes a protrusion extending toward a radial direction of the fixing pillar.

4. The key structure according to claim 3, wherein the protrusion abuts against a surface of the substrate that away from the membrane circuit.

5. The key structure according to claim 1, wherein a distance between two sides of the first end portion of the scissors structure is larger than a distance between two sides of the second end portion.

6. A keyboard comprising:

a case;

a substrate disposed in the case and including a plurality of first perforations;

a membrane circuit disposed on the substrate and including a plurality of second perforations;

a waterproof structure disposed on the membrane circuit and including a waterproof plate, a plurality of waterproof walls and a plurality of fixing pillars, wherein the waterproof plate includes a plurality of through holes, each of the waterproof walls surrounds the through hole and extends toward a direction opposite to the membrane circuit, and each of the fixing pillars is fixed to a surface of the waterproof plate adjacent to the membrane circuit and extends toward a direction opposite to the waterproof walls to pass through one of the plurality of first perforations and one of the plurality of second perforations;

a plurality of keycaps;

a plurality of conduction switches, wherein an end of the conduction switch passes through the through hole to be disposed on the membrane circuit, and the other end of the conduction switch protrudes out of the waterproof walls to be connected to the keycap; and a plurality of scissors structures, wherein each of the scissors structures includes a first end portion and a second end portion, the first end portion is pivotally connected to the keycap, and the second end portion is pivotally connected to the waterproof walls for the keycap to move up and down relatively to the membrane circuit.

7. The key structure according to claim 6, wherein a side edge of the waterproof plate is connected to a side wall of the case.

* * * * *